US009576512B2

(12) United States Patent
Park et al.

(10) Patent No.: US 9,576,512 B2
(45) Date of Patent: Feb. 21, 2017

(54) DISPLAY PANEL AND METHOD FOR TESTING DISPLAY PANEL

(71) Applicant: LG Display Co., Ltd., Seoul (KR)

(72) Inventors: Jae Chul Park, Daegu (KR); Je Hyung Park, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 485 days.

(21) Appl. No.: 13/942,902

(22) Filed: Jul. 16, 2013

(65) Prior Publication Data

US 2014/0145739 A1 May 29, 2014

(30) Foreign Application Priority Data

Nov. 23, 2012 (KR) ..... 10-2012-0133434

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01)

(58) Field of Classification Search
None
See application file for complete search history.

(56) References Cited

U.S. PATENT DOCUMENTS 8,159,438 B2 * 4/2012 Nakajima ..... G09G 3/2011 345/208
2002/0122017 A1 * 9/2002 Mikoshiba ..... G09G 3/298 345/66
2004/0174183 A1 9/2004 Nojiri et al.
2005/0264503 A1 12/2005 Wu et al.
2006/0186913 A1 8/2006 Kim
2008/0231575 A1 * 9/2008 Feng ..... G09G 3/3614 345/89
2011/0242065 A1 * 10/2011 Hsu ..... G09G 3/006 345/204
2012/0026206 A1 * 2/2012 Moon ..... G09G 3/3614 345/690
2012/0026447 A1 * 2/2012 Xi ..... G02F 1/136213 349/144

FOREIGN PATENT DOCUMENTS

| | | | |
|---|---|---|---|
| CN | 1527104 A | | 9/2004 |
| CN | 1825176 A | | 8/2006 |
| CN | 101819366 A | | 9/2010 |
| JP | 2001-183614 A | | 7/2001 |
| JP | 2001183614 A | * | 7/2001 |
| KR | 10-2011-0060376 A | | 6/2011 |

* cited by examiner

*Primary Examiner* — Paresh Patel
(74) *Attorney, Agent, or Firm* — Birch, Stewart, Kolasch & Birch, LLP

(57) ABSTRACT

A display panel including a display part including a plurality of sub-pixels configured to display a plurality of colors, and a plurality of data lines connected with the sub-pixels; a first test part configured to supply a test signal to (2K−1)th data lines ('K' is an integer above 0) by each color for the sub-pixels among the plurality of data lines; and a second test part configured to supply a test signal to 2Kth data lines by each color for the sub-pixels among the plurality of data lines when the first test part supplies the test signal. Further, a polarity of the test signal supplied by the second test part is opposite to a polarity of the test signal supplied by the first test part.

13 Claims, 7 Drawing Sheets

DISPLAY PANEL AND METHOD FOR TESTING DISPLAY PANEL

CROSS REFERENCE TO RELATED APPLICATIONS

This application claims the benefit of the Korean Patent Application No. 10-2012-0133434 filed on Nov. 23, 2012, which is hereby incorporated by reference as if fully set forth herein.

BACKGROUND OF THE INVENTION

Field of the Invention

Embodiments of the present invention relate to a method for testing whether or not a display panel is normally operated.

Discussion of the Related Art

Display devices such as a liquid crystal display (LCD), organic light-emitting diodes (OLED), plasma display panel (PDP) and electrophoretic display (EPD) may be manufactured by various processes including a process of testing lighting for a display panel. In more detail, an image is displayed on the display panel included in the display device. The process of testing lighting can be performed by supplying a predetermined test signal to the display panel, and testing whether or not the display panel is normally operated according to the predetermined test signal.

For example, FIG. 1 is a schematic view illustrating a related art display panel, and FIG. 2 is a schematic view illustrating the display panel when a process of testing lighting is performed.

Referring to FIG. 1, the related art display panel 10 includes a display part 11 and a testing part 12. The display part 11 includes a plurality of sub-pixels SP defined by a plurality of gate lines GL1 to GLn and a plurality of data lines DL1 to DLm, in which the gate line and the data line cross each other. The plurality of data lines DL1 to DLm are also connected to the testing part 12.

Further, the testing part 12 alternately supplies a positive polarity (+) test signal and a negative polarity (−) test signal with respect to a common voltage Vcom to the data lines DL1 to DLm. That is, the testing part 12 transmit the positive polarity (+) test signal and the negative polarity (−) test signal, which are supplied from a testing apparatus, to the data lines DL1 to DLm, whereby the positive polarity (+) test signal and the negative polarity (−) test signal are alternately supplied to the data lines DL1 to DLm. The data lines DL1 to DLm are also connected to the testing part 12 through one connection line.

As the testing part 12 alternately supplies the positive polarity (+) test signal and the negative polarity (−) test signal to the data lines DL1 to DLm, the sub-pixels SP included in the display panel 10 according to the related art are driven and emit light in units of a frame, to thereby perform a lighting test. For example, all the sub-pixels SP of the display panel 10 according to the related art are driven according to the positive polarity (+) test signal during a first frame, and then all the sub-pixels SP are driven according to the negative polarity (−) test signal during a second frame.

According to these repetitive driving operations, the lighting test is performed. That is, a frame inversion method is performed by repetitively inverting a voltage polarity in unit of a frame in all the sub-pixels SP of the display panel 10 according to the related art.

However, because the lighting test is performed in the frame inversion method, a flicker occurs due to a low frequency for the test signal, which causes problems in the lighting test. In order to overcome this flicker problem, a method of increasing a frequency for the test signal has been proposed. However, if the frequency is increased for the test signal, the time for applying the positive polarity (+) test signal and negative polarity (−) test signal to the data lines DL1 to DLm becomes short. Thus, as shown in FIG. 2, some of the sub-pixels SP included in the display panel 10 are driven in an incomplete charging state, whereby a lighting level in some sub-pixels SP driven in the incomplete charging state is relatively lower. Therefore, based on the testing results, even though the sub-pixels SP have a good quality, a classification the lighting level in the sub-pixels SP is marked as having a poor quality.

SUMMARY OF THE INVENTION

Accordingly, one object of the present invention is to provide a display panel and a method for testing the display panel that substantially obviate one or more problems due to limitations and disadvantages of the related art.

Another object of the present invention is to provide a display panel and a method for testing the display panel for preventing sub-pixels with a good quality, driven in an incomplete charging state, from being classified as a poor or bad quality.

Still another object of the present invention is to provide a display panel and method for testing the display panel that uses line inversion test method and corresponding test apparatus.

To achieve these and other advantages and in accordance with the purpose of embodiments of the invention, as embodied and broadly described herein, the present invention provides in one aspect a method of testing a display panel including a plurality of first sub-pixels for displaying a first color, a plurality of second sub-pixels for displaying a second color, and a plurality of third sub-pixels for displaying a third color. The method includes supplying a first test signal to (2K−1)th first data lines ('K' is an integer above 0) among first data lines connected with the first sub-pixels; and supplying a second test signal whose polarity is opposite to that of the first test signal to 2Kth first data lines among the first data lines when the first test signal is supplied to the (2K−1)th first data lines so as to alternately light the first sub-pixels connected with the (2K−1)th first data lines and the first sub-pixels connected with the 2Kth first data lines.

In another aspect, the present invention provides a method of testing a display panel, and which includes supplying a positive polarity test signal to (2K−1)th data lines among a plurality of data lines included in the display panel, and simultaneously supplying a negative polarity test signal to 2Kth data lines; and supplying the negative polarity test signal to the (2K−1)th data lines, and simultaneously supplying the positive polarity test signal to the 2Kth data lines.

In still a further aspect, the present invention provides a display panel including a display part including a plurality of sub-pixels configured to display a plurality of colors, and a plurality of data lines connected with the sub-pixels; a first test part configured to supply a test signal to (2K−1)th data lines ('K' is an integer above 0) by each color for the sub-pixels among the plurality of data lines; and a second test part configured to supply a test signal to 2Kth data lines by each color for the sub-pixels among the plurality of data lines when the first test part supplies the test signal. Further, a polarity of the test signal supplied by the second test part is opposite to a polarity of the test signal supplied by the first test part.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a display panel according to embodiments of the present invention will be described in detail with reference to the accompanying drawings.

Figure 1:
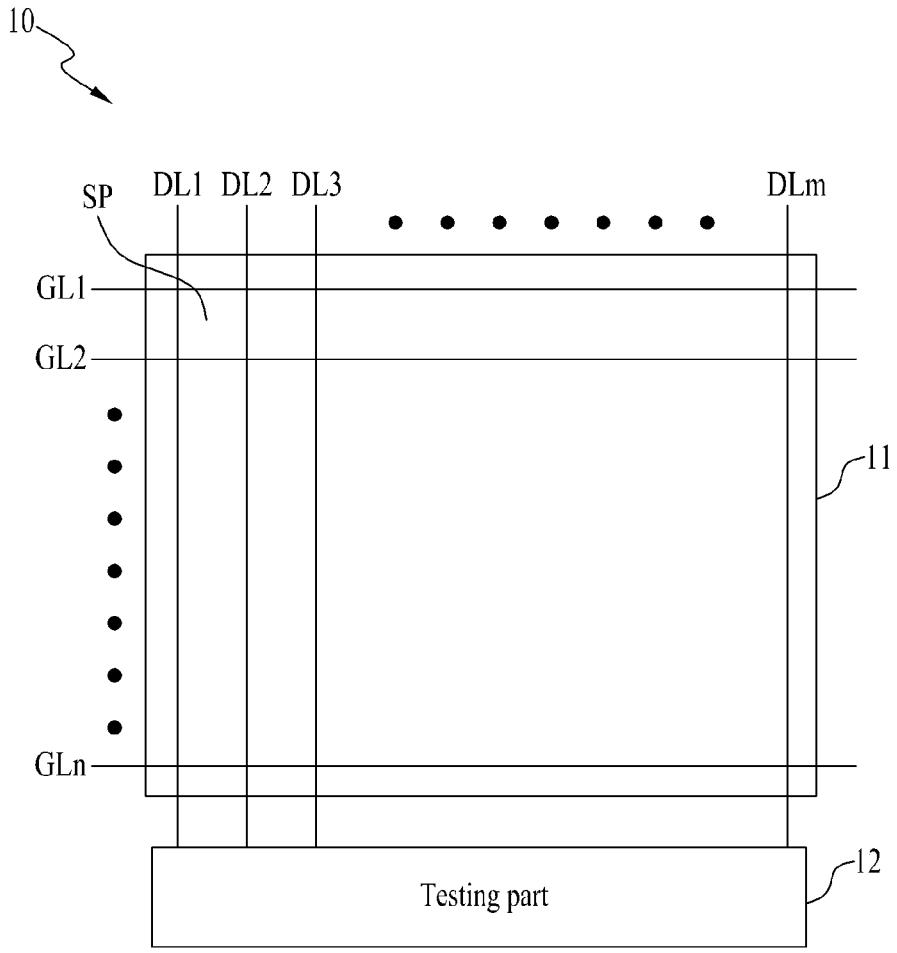
FIG. 1 Related Art
FIG. 1 is a schematic diagram illustrating a related art display panel.
Figure 2:
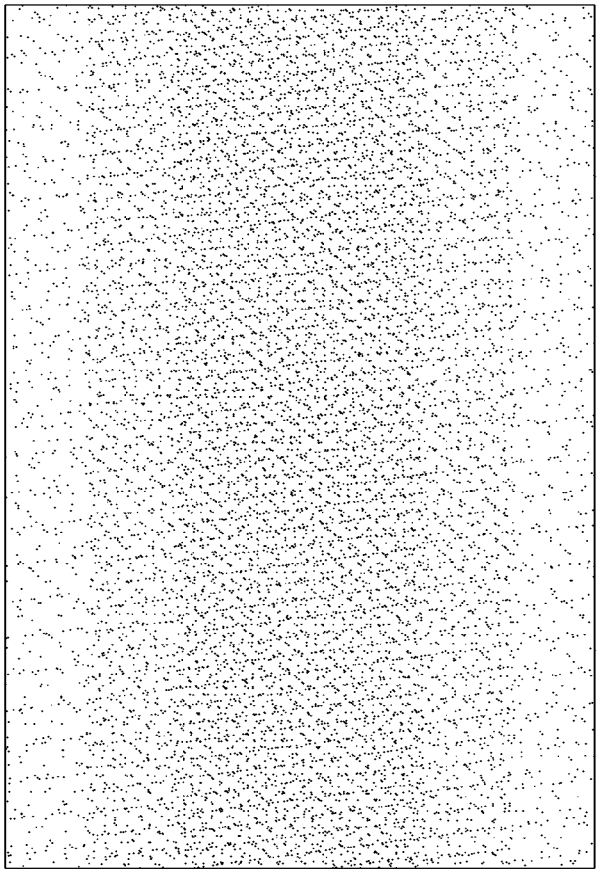
FIG. 2 Related Art
FIG. 2 is a schematic view illustrating the related art display panel when a process of testing lighting is performed.
Figure 3:
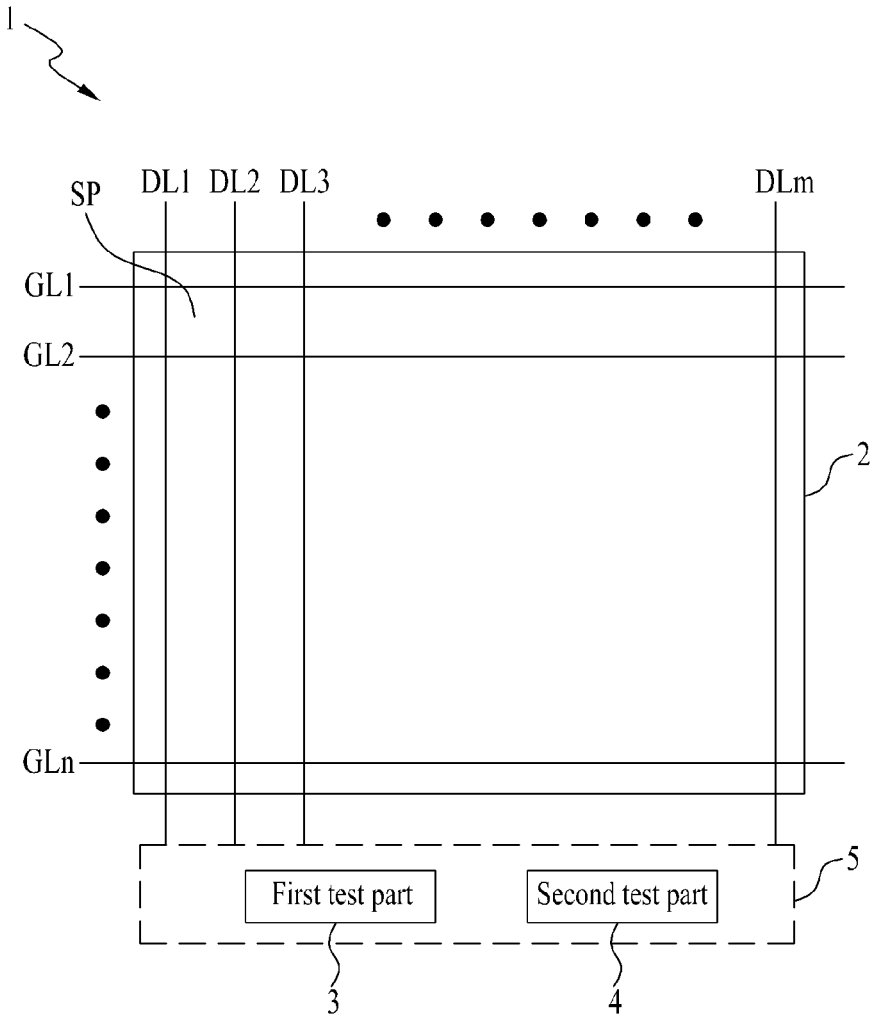
FIGS. 3 and 4 are schematic diagrams illustrating a display panel according to an embodiment of the present invention.

Referring to FIG. 3, the display panel 1 according to an embodiment of the present invention displays an image in display devices such as an LCD, OLED, PDP and EPD. Further, a lighting test for the display panel 1 is performed according to an embodiment of the present invention so as to check whether or not the display panel 1 is normally driven through the use of test apparatus such as an Auto-Probe Apparatus.

As shown in FIG. 3, the display panel 1 includes a display part 2, a first test part 3 and a second test part 4 used for the lighting test. The first test part 3 and the second test part 4 are positioned in a non-display part 5 corresponding to a circumferential area of the display part 2.

In addition, a plurality of data lines D1 to Dm, a plurality of gate lines G1 to Gn, and a plurality of sub-pixels SP are formed in the display part 2, in which each sub-pixel SP is defined by the gate line and data line crossing each other. Further, the data lines D1 to Dm are connected with the sub-pixels SP. A thin film transistor TFT for switching the sub-pixels SP is also formed at each crossing region of the gate lines G1 to Gn and data lines D1 to Dm.

Figure 4:
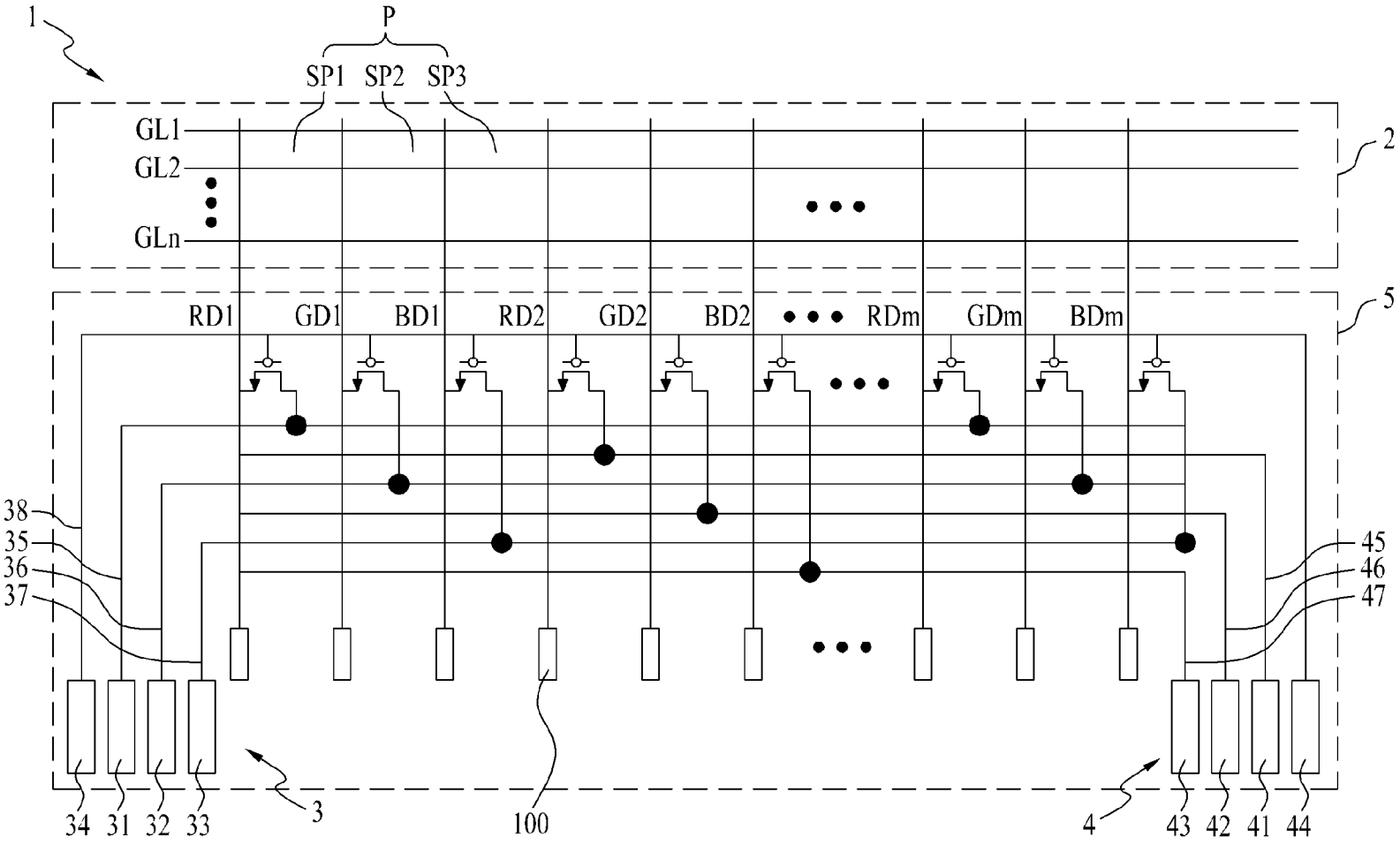

Referring to FIG. 4, the plurality of sub-pixels SP1, SP2 and SP3 form a unit pixel P, and the display part 2 includes the plurality of unit pixels P. Each unit pixel P includes a first sub-pixel SP1 for displaying a first color, a second sub-pixel SP2 for displaying a second color, and a third sub-pixel for displaying a third color. In this instance, the first, second and third colors are different from one another.

For example, each unit pixel P may include the first sub-pixel SP1 for displaying red, the second sub-pixel SP2 for displaying green, and the third sub-pixel SP3 for displaying blue. However, the first color may be cyan, the second color may be magenta, and the third color may be yellow. Each unit pixel P may also include four or more sub-pixels SP (shown in FIG. 3) for displaying the different colors.

Hereinafter, the display panel 1 according to the embodiment of the present invention, which includes each unit pixel P including the first sub-pixel SP1 for displaying red, the second sub-pixel SP2 for displaying green and the third sub-pixel SP3 for displaying blue, will be described in more detail.

Referring to FIG. 4, the display part 2 includes the first data lines RD1 to RDm connected with the first sub-pixels SP1, the second data lines GD1 to GDm connected with the second sub-pixels SP2, and the third data lines BD1 to BDm connected with the third sub-pixels SP3. The data lines are also repetitively arranged in the sequential order of the first data lines RD1 to RDm, the second data lines GD1 to GDm, and the third data lines BD1 to BDm.

Referring to FIG. 3, the first test part 3 is connected with some of the data lines D1 to Dm, and supplies a test signal to the corresponding data lines. The test signal is also supplied from the test apparatus. As the test apparatus is brought into contact with the first test part 3, the test signal is supplied to some of the data lines D1 to Dm through the first test part 3.

In addition, the test apparatus can supply the first and second test signals, where the first test signal alternately applies a positive polarity (+) test signal and negative polarity (−) test signal, in sequence, with respect to a common voltage Vcom; and the second test signal alternately applies a negative polarity (−) test signal and positive polarity (+) test signal, in sequence, with respect to the common voltage Vcom.

Further, the second test part 4 is connected with some of the data lines D1 to Dm, and supplies the test signal to the corresponding data lines. As the test apparatus is brought into contact with the second test part 4, the test signal is supplied to some of the data lines D1 to Dm through the second test part 4. The test apparatus can also supply the first test signal and the second test signal through the second test part 4.

Referring to FIG. 4, the second test part 4 supplies the test signal to the 2Kth data lines ('K' is an integer above 0) by each color for the sub-pixels SP1, SP2 and SP3. In addition, the first test part 3 supplies the test signal to the (2K−1)th data lines by each color for the sub-pixels SP1, SP2 and SP3. In this instance, when the first test part 3 supplies the test signal, the second test part 4 supplies the test signal whose polarity is opposite to that of the test signal supplied by the first test part 3, which will be described in detail as follows.

In addition, when the first data lines RD1 to RDm are connected with the first sub-pixels SP1, the (2K−1)th first data lines among the first data lines RD1 to RDm are connected with the first test part 3. Also, the 2Kth first data lines among the first data lines RD1 to RDm are connected with the second test part 4. In this instance, the first test part 3 and the second test part 4 respectively supply the test signals having the opposite polarities to the (2K−1)th first data lines and 2Kth first data lines at the same time.

For example, if the first test part 3 supplies the positive polarity (+) test signal to the (2K−1)th first data lines, the second test part 4 supplies the negative polarity (−) test signal to the 2Kth first data lines. If the first test part 3 supplies the negative polarity (−) test signal to the (2K−1)th first data lines, the second test part 4 supplies the positive polarity (+) test signal to the 2Kth first data lines. That is, if the first test part 3 supplies the first test signal to the (2K−1)th first data lines, the second test part 4 supplies the second test signal to the 2Kth first data lines.

In more detail, the first test part 3 supplies the test signal having a positive polarity to the odd numbered Red sub-pixels (1, 3, 5, 7, etc.) in the first supplying step and the second test part 4 supplies the test signal having a negative polarity to the even numbered Red sub-pixels (2, 4, 6, 8, etc.) in a line inversion method. The process then continues for other sup-pixel colors.

Accordingly, the first test part 3 and the second test part 4 alternately drive and light the first sub-pixels SP1 connected with the (2K−1)th first data lines, and the first sub-pixels SP1 connected with the 2Kth first data lines during the lighting test. Thus, the display panel 1 according to an embodiment of the present invention prevents the occurrence of flicker during the lighting test regarding the first sub-pixels SP1, thereby facilitating the process of the lighting test.

Also, the display panel 1 according to an embodiment of the present invention prevents occurrence of flicker, thereby allowing a decrease of a frequency for the test signal. Thus, the display panel 1 according to an embodiment of the present invention increases the time for applying the positive polarity (+) test signal and the negative polarity (−) test signal to the first sub-pixels SP1, and thereby increases the time for charging the first sub-pixels SP1 with a pixel voltage. As discussed previously, when some of the first sub-pixels SP1 having a good quality are driven in the incomplete charging state, they might be classified as poor quality. However, in the display panel 1 according to an embodiment of the present invention, it is possible to prevent some of the first sub-pixels SP1 having a good quality, driven in the incomplete charging state, from being mistakenly classified as a poor quality, thereby improving the accuracy and reliability of the lighting test.

Then, when the second data lines GD1 to GDm are connected with the second sub-pixels SP2, the (2K−1)th second data lines among the second data lines GD1 to GDm are connected with the first test part 3. Also, the 2Kth second data lines among the second data lines GD1 to GDm are connected with the second test part 4. In this instance, the first test part 3 and the second test part 4 respectively supply the test signals having the opposite polarities to the (2K−1)th second data lines and 2Kth second data lines at the same time.

For example, if the first test part 3 supplies the negative polarity (−) test signal to the (2K−1)th second data lines, the second test part 4 supplies the positive polarity (+) test signal to the 2Kth second data lines. If the first test part 3 supplies the positive polarity (+) test signal to the (2K−1)th second data lines, the second test part 4 supplies the negative polarity (−) test signal to the 2Kth second data lines. That is, if the first test part 3 supplies the second test signal to the (2K−1)th second data lines, the second test part 4 supplies the first test signal to the 2Kth second data lines.

In more detail, the first test part 3 supplies the test signal having a positive polarity to the odd numbered Green sub-pixels (1, 3, 5, 7, etc.) in the first supplying step and the second test part 4 supplies the test signal having a negative polarity to the even numbered Green sub-pixels (2, 4, 6, 8, etc.) in a line inversion method. The opposite polarities can also be used. For example, the first test part 3 supplies the test signal having a negative polarity to the odd numbered Green sub-pixels (1, 3, 5, 7, etc.) in the first supplying step and the second test part 4 supplies the test signal having a positive polarity to the even numbered Green sub-pixels (2, 4, 6, 8, etc.) in a line inversion method. In this second example, the polarities are opposite to the polarities used for the Red sub-pixels.

Accordingly, the first test part 3 and the second test part 4 alternately drive and light the second sub-pixels SP2 connected with the (2K−1)th second data lines, and the second sub-pixels SP2 connected with the 2Kth second data lines during the lighting test. Thus, the display panel 1 according to an embodiment of the present invention prevents occurrence of flicker during the lighting test regarding the second sub-pixels SP2, and simultaneously increases the time for charging the second sub-pixels SP2 with the pixel voltage, thereby improving the accuracy and reliability on the lighting test.

Then, when the third data lines BD1 to BDm are connected with the third sub-pixels SP3, the (2K−1)th third data lines among the third data lines BD1 to BDm are connected with the first test part 3. Also, the 2Kth third data lines among the third data lines BD1 to BDm are connected with the second test part 4. In this instance, the first test part 3 and the second test part 4 respectively supply the test signals having the opposite polarities to the (2K−1)th third data lines and 2Kth third data lines at the same time.

For example, if the first test part 3 supplies the positive polarity (+) test signal to the (2K−1)th third data lines, the second test part 4 supplies the negative polarity (−) test signal to the 2Kth third data lines. If the first test part 3 supplies the negative polarity (−) test signal to the (2K−1)th third data lines, the second test part 4 supplies the positive polarity (+) test signal to the 2Kth third data lines. That is, if the first test part 3 supplies the first test signal to the (2K−1)th third data lines, the second test part 4 supplies the second test signal to the 2Kth third data lines.

Accordingly, the first test part 3 and the second test part 4 alternately drive and light the third sub-pixels SP3 connected with the (2K−1)th third data lines, and the third sub-pixels SP3 connected with the 2Kth third data lines during the lighting test. Thus, the display panel 1 according to an embodiment of the present invention prevents the occurrence of flicker during the lighting test regarding the third sub-pixels SP3, and simultaneously increases the time for charging the third sub-pixels SP3 with a pixel voltage, thereby improving the accuracy and reliability on the lighting test.

As mentioned above, the display panel 1 according to an embodiment of the present invention prevents occurrence of flicker and decreases a frequency for the test signal. Thus, the display panel 1 according to an embodiment of the present invention can perform the lighting test by using a test signal whose frequency is identical to that of a driving signal used when virtually driving the display device. For example, assuming the display device is driven by the driving signal of 60 Hz frequency, it is possible to prevent the occurrence of flicker even though the lighting test using the test signal of 60 Hz frequency is performed in the display panel 1. Accordingly, the lighting test for the display panel 1 can be performed under the same condition as the virtual driving environment of the display device, thereby realizing a more-improved accuracy and reliability of the lighting test.

During the process of the above-mentioned lighting test, the test apparatus may change a voltage level of the test signal to be applied to the first data lines RD1 to RDm, the second data lines GD1 to GDm, and the third data lines BD1 to BDm through the first test part 3 and the second test part 4. As a grayscale is changed based on the voltage level of the test signal, the lighting test for the display panel 1 can be performed by each grayscale.

Figure 5:
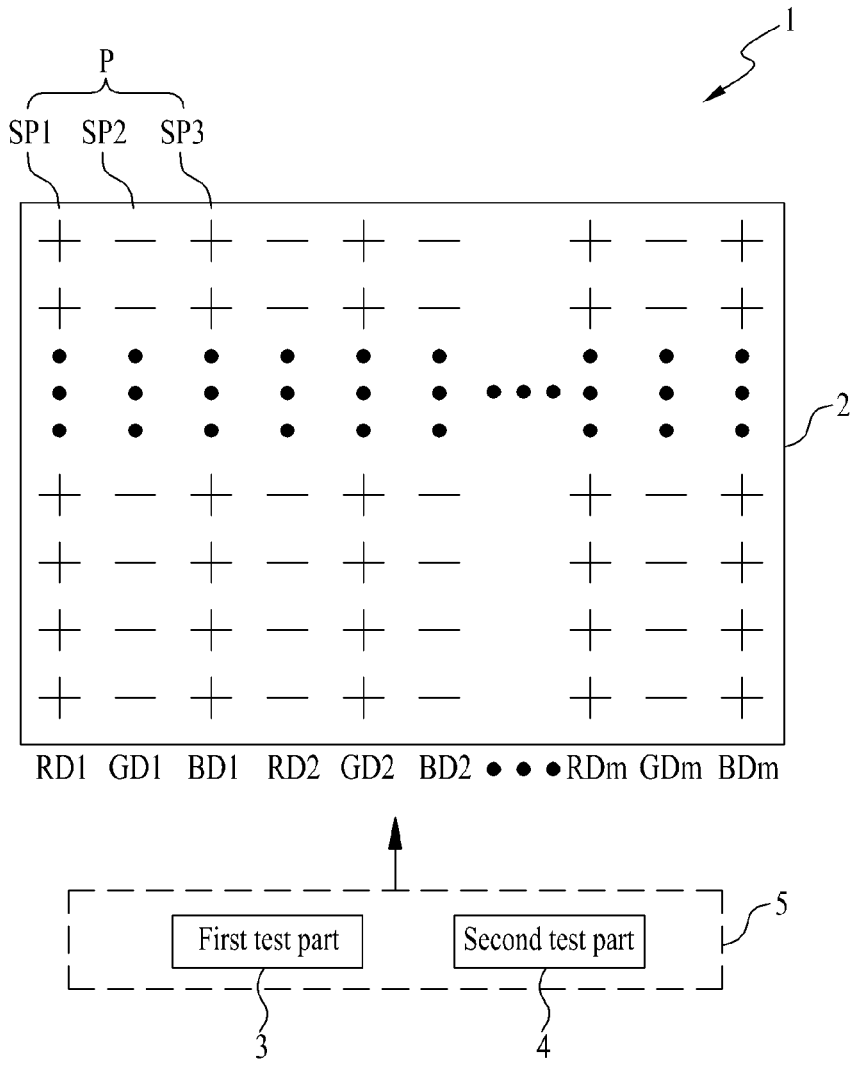
FIGS. 5 and 6 are schematic diagrams illustrating a process for testing the display panel according to an embodiment of the present invention.
Figure 6:
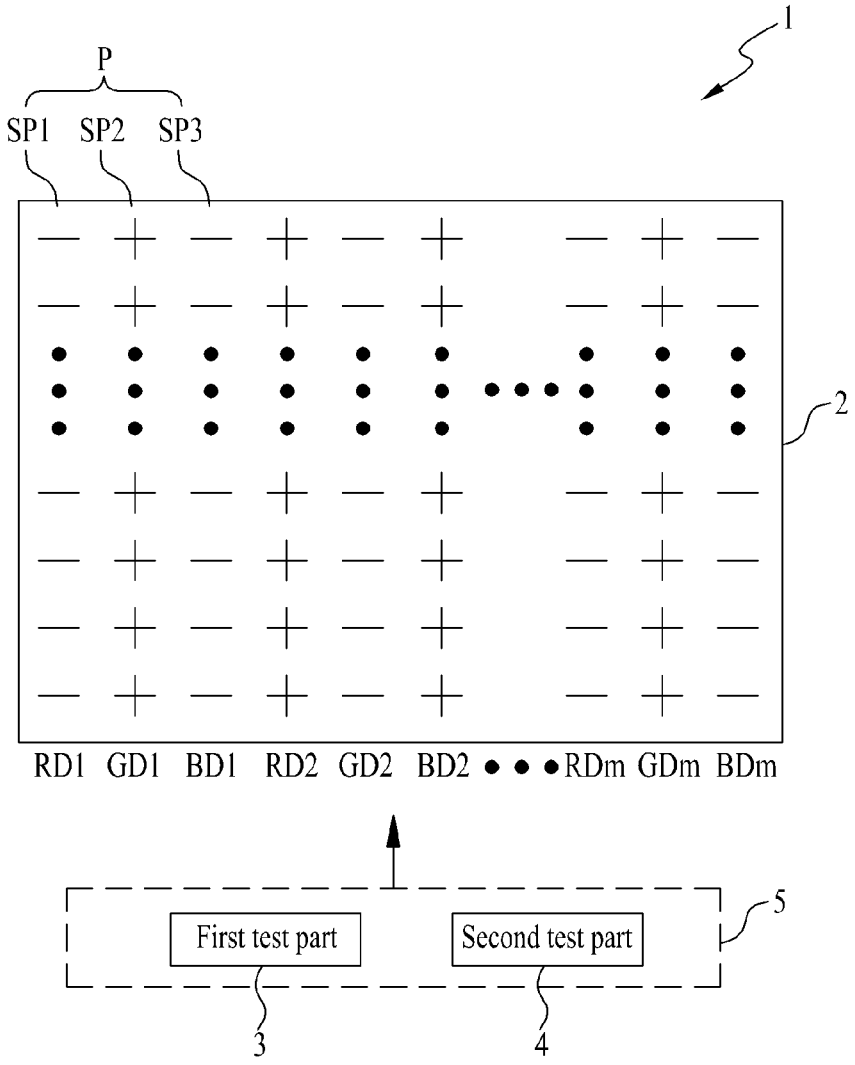

Referring to FIGS. 4 to 6, the first test part 3 and the second test part 4 can simultaneously supply the test signals having the opposite polarities to the (2K−1)th data line and the 2K data line regardless of color. That is, the lighting test for the display panel 1 may be performed in a column inversion method, which will be described in detail as follows.

First, the plurality of unit pixels P may be formed in the arrangement direction of the data lines RD1 to RDm, GD1 to GDm and BD1 to BDm, where each unit pixel P includes the first sub-pixel SP1, the second sub-pixel SP2 and the third sub-pixel SP3 positioned in sequence. Further, the second sub-pixel SP2 is positioned next to the first sub-pixel SP1, and the third sub-pixel SP3 is positioned next to the second sub-pixel SP2. That is, the second sub-pixel SP2 is positioned between the first sub-pixel SP1 and the third sub-pixel SP3.

Then, as shown in FIG. 5, the first test part 3 supplies the positive polarity (+) test signal to the (2K−1)th first data lines among the first data lines RD1 to RDm connected with the first sub-pixels SP1. The first test part 3 also supplies the negative polarity (−) test signal to the (2K−1)th second data lines among the second data lines GD1 to GDm connected with the second sub-pixels SP2.

Then, the first test part 3 supplies the positive polarity (+) test signal to the (2K−1)th third data lines among the third data lines BD1 to BDm connected with the third sub-pixels SP3. Accordingly, the first sub-pixels SP1 of the (2K−1)th unit pixels P are supplied with the positive polarity (+) test signal, the second sub-pixels SP1 of the (2K−1)th unit pixels P are supplied with the negative polarity (−) test signal, and the third sub-pixels SP3 of the (2K−1)th unit pixels P are supplied with the positive polarity (+) test signal.

Simultaneously, the second test part 4 supplies the negative polarity (−) test signal to the 2Kth first data lines among the first data lines RD1 to RDm, supplies the positive polarity (+) test signal to the 2Kth second data lines among the second data lines GD1 to GDm, and supplies the negative polarity (−) test signal to the 2Kth third data lines among the third data lines BD1 to BDm. Thus, the first sub-pixels SP1 of the 2Kth unit pixels P are supplied with the negative polarity (−) test signal, the second sub-pixels SP2 of the 2Kth unit pixels P are supplied with the positive polarity (+) test signal, and the third sub-pixels SP3 of the 2Kth unit pixels P are supplied with the negative polarity (−) test signal.

As a result, the lighting test for the display panel 1 can be performed in the column inversion method as the test signal is sequentially supplied in order of positive polarity, negative polarity, positive polarity, negative polarity, positive polarity and negative polarity, along the arrangement direction of the data lines RD1 to RDm, GD1 to GDm, and BD1 to BDm. Accordingly, the lighting test for the display panel 1 can be performed under the same condition as the virtual driving environment of the display device, thereby realizing a more-improved accuracy and reliability on the lighting test.

Next, as shown in FIG. 6, the first test part 3 supplies the negative polarity (−) test signal to the (2K−1)th first data lines, supplies the positive polarity (+) test signal to the (2K−1)th second data lines, and supplies the negative polarity (−) test signal to the (2K−1)th third data lines. Accordingly, the first sub-pixels SP1 of the (2K−1)th unit pixels P are supplied with the negative polarity (−) test signal, the second sub-pixels SP1 of the (2K−1)th unit pixels P are supplied with the positive polarity (+) test signal, and the third sub-pixels SP3 of the (2K−1)th unit pixels P are supplied with the negative polarity (−) test signal.

Simultaneously, the second test part 4 supplies the positive polarity (+) test signal to the 2Kth first data lines, supplies the negative polarity (−) test signal to the 2Kth second data lines, and supplies the positive polarity (+) test signal to the 2Kth third data lines. Thus, the first sub-pixels SP1 of the 2Kth unit pixels P are supplied with the positive polarity (+) test signal, the second sub-pixels SP2 of the 2Kth unit pixels P are supplied with the negative polarity (−) test signal, and the third sub-pixels SP3 of the 2Kth unit pixels P are supplied with the positive polarity (+) test signal.

As a result, the lighting test for the display panel 1 can be performed in the column inversion method as the test signal is sequentially supplied in order of positive polarity, negative polarity, positive polarity, negative polarity, positive polarity and negative polarity along the arrangement direction of the data lines RD1 to RDm, GD1 to GDm, and BD1 to BDm, as shown in FIG. 5, and then the test signal is sequentially supplied in order of negative polarity, positive polarity, negative polarity, positive polarity, negative polarity and positive polarity along the arrangement direction of the data lines RD1 to RDm, GD1 to GDm, and BD1 to BDm, as shown in FIG. 6.

Thereafter, the process of sequentially supplying the test signal in order of positive polarity, negative polarity, positive polarity, negative polarity, positive polarity and negative polarity, as shown in FIG. 5, and the following process of sequentially supplying the test signal in order of negative polarity, positive polarity, negative polarity, positive polarity, negative polarity and positive polarity, as shown in FIG. 6, can be repeatedly performed. That is, the first test part 3 supplies the first test signal to the (2K−1)th first data lines, supplies the second test signal to the (2K−1)th second data lines, and supplies the first test signal to the (2K−1)th third data lines.

Then, the second test part 4 supplies the second test signal to the 2Kth first data lines, supplies the first test signal to the 2Kth second data lines, and supplies the second test signal to the 2Kth third data lines. During the process of lighting test in the display panel 1, as the voltage level of the test signal supplied through the first test part 3 and the second test part 4 is changed, the grayscale is also changed, whereby the lighting test can be performed by each grayscale. In addition, a scan signal is supplied to the gate lines GL1 to GLn during the above process of the lighting test.

Referring to FIGS. 4 to 7, the non-display part (see '5' of FIG. 4) is positioned in the circumference of the display part 2. A driver IC is also provided in the non-display part 5. A plurality of driving pads 100, which supply data signals to the data lines RD1 to RDm, GD1 to GDm, and BD1 to BDm when the display device is driven virtually, are also included in the non-display part 5. The driving pads 100 are connected with the respective data lines RD1 to RDm, GD1 to GDm, and BD1 to BDm.

Further, the first test part 3 and the second test part 4 are formed in the non-display part 5. As shown in FIG. 4, the first test part 3 includes a first test pad 31, a second test pad 32, a third test pad 33, a first connection line 35, a second connection line 36, and a third connection line 37. In this instance, the first test pad 31, the second test pad 32, and the third test pad 33 are in contact with the test apparatus (see '200' of FIG. 7), and are supplied with the test signal from the test apparatus 200.

Also, the first connection line 35 is connected with the first test pad 31, the second connection line 36 is connected with the second test pad 32, and the third connection line 37 is connected with the third test pad 33. The test apparatus 200 also includes a body (see '210' of FIG. 7), and a test signal supplier (see '220' of FIG. 7) for supplying the test signal. The body 210 is connected with first contact members (see '211' of FIG. 7), which are to be in contact with the first test pad 31, the second test pad 32 and the third test pad 33.

When the first contact members 211 are brought into contact with the first test pad 31, the second test pad 32 and the third test pad 33, the test signal supplier 220 supplies the test signal through the first contact members 211, thereby performing the lighting test for the display panel 1 according to an embodiment of the present invention.

In addition, the first test pad 31 is positioned in the non-display part 5, and more particularly, the first test pad 31 is positioned at one side of the driving pads 100. As the test apparatus 200 is brought into contact with the first test pad 31, the test apparatus 200 is electrically connected with the first connection line 35 and the data lines connected with the first connection line 35. The first test pad 31 can thus be supplied with the first test signal from the test apparatus 200.

Further, the second test pad 32 is positioned in the non-display part 5, and more particularly, the second test pad 32 is positioned at one side of the driving pads 100. The second test pad 32 is also positioned between the first test pad 31 and the third test pad 33. As the test apparatus 200 is brought into contact with the second test pad 32, the test apparatus 200 is electrically connected with the second connection line 36 and the data lines connected with the second connection line 36. The second test pad 32 can thus be supplied with the second test signal from the test apparatus 200.

In addition, the third test pad 33 is positioned in the non-display part 5, and more particularly, the third test pad 33 is positioned at one side of the driving pads 100. As the test apparatus 200 is brought into contact with the third test pad 33, the test apparatus 200 is electrically connected with the third connection line 37 and the data lines connected with the third connection line 37. The third test pad 33 can thus be supplied with the first test signal from the test apparatus 200.

Further, the first connection line 35 connects the first test pad 31 with the (2K−1)th first data lines among the first data lines RD1 to RDm connected with the first sub-pixels SP1. As the test apparatus 200 is brought into contact with the first test pad 31, the first test signal is supplied to the (2K−1)th first data lines through the first connection line 35. The first connection line 35 can also be connected with the (2K−1)th first data lines through a switching element. For example, the switching element may be the thin film transistor TFT.

Also, the second connection line 36 connects the second test pad 32 with the (2K−1)th second data lines among the second data lines GD1 to GDm connected with the second sub-pixels SP2. As the test apparatus 200 is brought into contact with the second test pad 32, the second test signal is supplied to the (2K−1)th second data lines through the second connection line 36. The second connection line 36 can be connected with the (2K−1)th second data lines through a switching element. For example, the switching element may be the thin film transistor TFT.

In addition, the third connection line 37 connects the third test pad 33 with the (2K−1)th third data lines among the third data lines BD1 to BDm connected with the third sub-pixels SP3. As the test apparatus 200 is brought into contact with the third test pad 33, the first test signal is supplied to the (2K−1)th third data lines through the third connection line 37. The third connection line 37 may also be connected with the (2K−1)th third data lines through a switching element. For example, the switching element may be the thin film transistor TFT.

Figure 7:
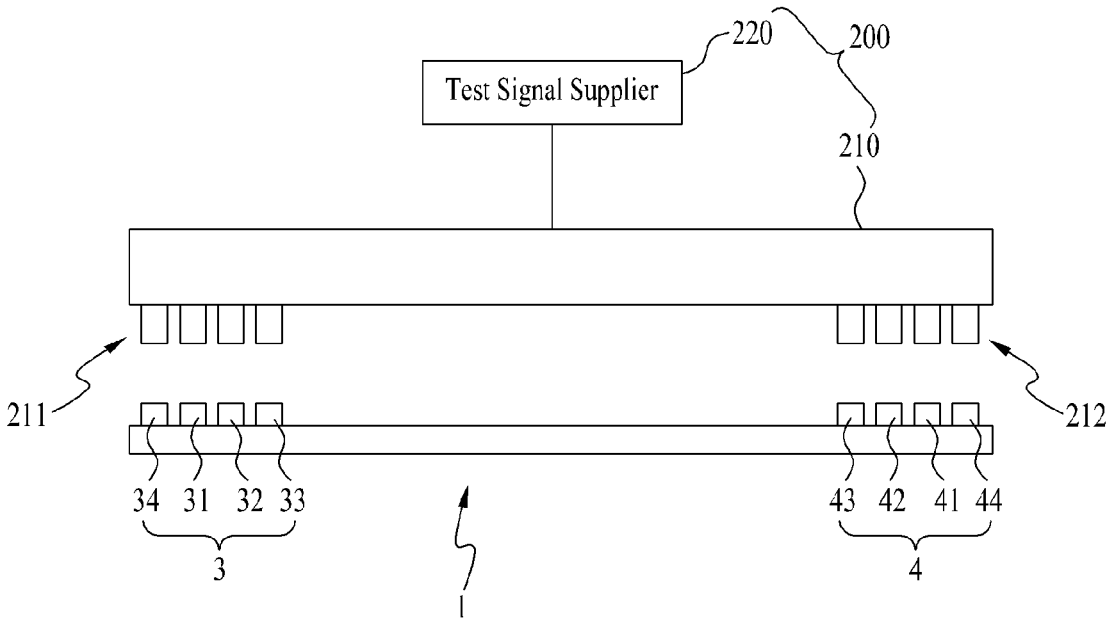
FIG. 7 is a lateral side diagram illustrating a process for bringing a testing apparatus into contact with the display panel according to an embodiment of the present invention.

Referring to FIGS. 4 and 7, the first test part 3 may further include a first enable pad 34 and a first enable connection line 38. The first enable pad 34 is positioned in the non-display part 5, and more particularly, the first enable pad 34 is positioned at one side of the driving pads 100. The first enable pad 34 is positioned next to the first test pad 31. Further, the first test pad 31 is positioned between the first enable pad 34 and the second test pad 32.

In addition, the first enable connection line 38 connects the first enable pad 34 with the respective switching elements included in the first connection line 35, the second connection line 36 and the third connection line 37. As the test apparatus (see '200' of FIG. 7) is brought into contact with the first enable pad 34, the test apparatus 200 is electrically connected with the first enable connection line 38 and the switching elements connected with the first enable connection line 38. The test apparatus 200 may supply an enable test signal through the first enable pad 34.

In this instance, the body (see '210' of FIG. 7) may be connected with first contact members (see '211' of FIG. 7) which are to be in contact with the first test pad 31, the second test pad 32, the third test pad 33 and the first enable pad 34. When the first contact members 211 are brought into contact with the first test pad 31, the second test pad 32, the third test pad 33 and the first enable pad 34, the test signal supplier (see '220' of FIG. 7) supplies the test signal through the first contact members 211, to thereby perform the lighting test for the display panel 1 according to an embodiment of the present invention.

Referring to FIGS. 4 and 7, the second test part 4 may include a fourth test pad 41, a fifth test pad 42, a sixth test pad 43, a fourth connection line 45, a fifth connection line 46, and a sixth connection line 47. In this instance, the fourth test pad 41, the fifth test pad 42, and the sixth test pad 43 are to be in contact with the test apparatus 200, and are supplied with the test signal from the test apparatus 200. Also, the fourth connection line 45 is connected with the fourth test pad 41, the fifth connection line 46 is connected with the fifth test pad 42, and the sixth connection line 47 is connected with the sixth test pad 43.

In addition, the body (see '210' of FIG. 7) may include second contact members (see '212' of FIG. 7) which are to be in contact with the fourth test pad 41, the fifth test pad 42 and the sixth test pad 43. When the second contact members 212 are brought into contact with the fourth test pad 41, the fifth test pad 42 and the sixth test pad 43, the test signal supplier (see '220' of FIG. 7) supplies the test signal through the second contact members 212, to thereby perform the lighting test for the display panel 1 according to an embodiment of the present invention. The second contact members 212 are provided at a predetermined interval from the first contact members 211.

Further, the fourth test pad 41 is positioned in the non-display part 5, and more particularly, the fourth test pad 41 is positioned at the other side of the driving pads 100. As the test apparatus 200 is brought into contact with the fourth test pad 41, the test apparatus 200 is electrically connected with the fourth connection line 45 and the data lines connected with the fourth connection line 45. The fourth test pad 41 may be supplied with the second test signal from the test apparatus 200.

In addition, the fifth test pad 42 is positioned in the non-display part 5, and more particularly, the fifth test pad 42 is positioned at the other side of the driving pads 100. The fifth test pad 42 is positioned between the fourth test pad 41 and the sixth test pad 43. As the test apparatus 200 is brought into contact with the fifth test pad 42, the test apparatus 200 is electrically connected with the fifth connection line 46 and the data lines connected with the fifth connection line 46. The fifth test pad 42 can thus be supplied with the first test signal from the test apparatus 200.

Further, the sixth test pad 43 is positioned in the non-display part 5, and more particularly, the sixth test pad 43 is positioned at the other side of the driving pads 100. As the test apparatus 200 is brought into contact with the sixth test pad 43, the test apparatus 200 is electrically connected with the sixth connection line 47 and the data lines connected with the sixth connection line 47. The sixth test pad 43 can thus be supplied with the second test signal from the test apparatus 200.

In addition, the fourth connection line 45 connects the fourth test pad 41 with the 2Kth first data lines among the first data lines RD1 to RDm connected with the first sub-pixels SP1. As the test apparatus 200 is brought into contact with the fourth test pad 41, the second test signal is supplied to the 2Kth first data lines through the fourth connection line 45. The fourth connection line 45 can also be connected with the 2Kth first data lines through a switching element. For example, the switching element can be the thin film transistor TFT.

Further, the fifth connection line 46 connects the fifth test pad 42 with the 2Kth second data lines among the second data lines GD1 to GDm connected with the second sub-pixels SP2. As the test apparatus 200 is brought into contact with the fifth test pad 42, the first test signal is supplied to the 2Kth second data lines through the fifth connection line 46. The fifth connection line 46 can also be connected with the 2Kth second data lines through a switching element. For example, as discussed above, the switching element can be the thin film transistor TFT.

In addition, the sixth connection line 47 connects the sixth test pad 43 with the 2Kth third data lines among the third data lines BD1 to BDm connected with the third sub-pixels SP3. As the test apparatus 200 is brought into contact with the sixth test pad 43, the second test signal is supplied to the 2Kth third data lines through the sixth connection line 47. The sixth connection line 47 can also be connected with the 2Kth third data lines through a switching element such as the thin film transistor TFT.

Referring to FIGS. 4 and 7, the second test part 4 may further include a second enable pad 44. The second enable pad 44 is positioned in the non-display part 5, and more particularly, the second enable pad 44 is positioned at the other side of the driving pads 100. The second enable pad 44 is also positioned next to the fourth test pad 41, and the fourth test pad 41 is positioned between the second enable pad 44 and the fifth test pad 42. Further, the second enable pad 44 may be connected with the switching elements included in the fourth connection line 45, the fifth connection line 46 and the sixth connection line 47 through the first enable connection line 38.

Therefore, the test apparatus 200 can supply the enable test signal through the second enable pad 44. In this instance, the body (see '210' of FIG. 7) can be connected with second contact members (see '212' of FIG. 7) which are to be in contact with the fourth test pad 41, the fifth test pad 42, the sixth test pad 43 and the second enable pad 44. When the second contact members 212 are brought into contact with the fourth test pad 41, the fifth test pad 42, the sixth test pad 43 and the second enable pad 44, the test signal supplier (see '220' of FIG. 7) supplies the test signal through the second contact members 212, to thereby perform the lighting test for the display panel 1 according to an embodiment of the present invention.

In addition, the second test part 4 may further include a second enable connection line. In more detail, the second enable connection line can connect the second enable pad 44 with the switching elements included in the fourth connection line 45, the fifth connection line 46 and the sixth connection line 47. As the test apparatus 200 is brought into contact with the second enable pad 44, the test apparatus 200 can be electrically connected with the second enable connection line and the switching elements connected with the second enable connection line.

Hereinafter, a method of testing the display panel according to an embodiment of the present invention will be described in detail with reference to the accompanying drawings.

First, the first test signal is supplied to the (2K−1)th data lines among the plurality of data lines D1 to Dm (shown in FIG. 3) included in the display panel 1. This process may be performed by supplying the first test signal to the (2K−1)th data lines through the first test part 3 and the second test part 4, where the first test signal alternately applies the positive polarity (+) test signal and the negative polarity (−) test signal, in sequence, with respect to the common voltage Vcom. The process of supplying the first test signal to the (2K−1)th data lines includes bringing the test apparatus (see '200' of FIG. 7) into contact with the first test part 3 and the second test part 4, and supplying the first test signal to the (2K−1)th data lines from the test apparatus 200 through the first test part 3 and the second test part 4.

Then, the second test signal whose polarity is opposite to that of the first test signal is supplied to the 2Kth data lines among the plurality of data lines D1 to Dm included in the display panel 1. This process can be performed by supplying the second test signal to the 2Kth data lines through the first test part 3 and the second test part 4, where the second test signal alternately applies the negative polarity (−) test signal and the positive polarity (+) test signal, in sequence, with respect to the common voltage Vcom. The process of supplying the second test signal to the 2Kth data lines includes supplying the second test signal to the 2Kth data lines through the first test part 3 and the second test part 4 from the test apparatus 200 under the condition that the test apparatus (see '200' of FIG. 7) is brought into contact with the first test part 3 and the second test part 4.

Both the process of supplying the second test signal to the 2Kth data lines and the process of supplying the first test signal to the (2K−1)th data lines may be performed at the same time. Accordingly, The method of testing the display panel 1 can sequentially perform the first testing step of supplying the positive polarity (+) test signal to the (2K−1)th data lines and simultaneously supplying the negative polarity (−) test signal to the 2Kth data lines, and the second testing step of supplying the negative polarity (−) test signal to the (2K−1)th data lines and simultaneously supplying the positive polarity (+) test signal to the 2Kth data lines.

Thus, for the method of testing the display panel according to an embodiment of the present invention, the test signal is sequentially supplied in order of positive polarity, negative polarity, positive polarity, negative polarity, positive polarity and negative polarity, as shown in FIG. 5, along the arrangement direction of the data lines D1 to Dm during the first testing step; and then the test signal is sequentially supplied in order of negative polarity, positive polarity, negative polarity, positive polarity, negative polarity and positive polarity, as shown in FIG. 6, during the second testing step, to thereby carry out the lighting test in the column inversion method. Accordingly, the method of testing the display panel 1 can be performed under the same condition as the virtual driving environment of the display device, thereby realizing more-improved accuracy and reliability on the lighting test.

In more detail, and with reference to FIGS. 4 and 5, the testing method includes supplying a test signal having a positive polarity to odd numbered Red sub-pixels from the first test pad 31 of the first test part 3, and supplying a test signal having a negative polarity to even numbered Red sub-pixels from the fourth test pad 41 of the second test part 4. The method also includes supplying a test signal having a negative polarity to odd numbered Blue sub-pixels from the second test pad 31 of the first test part 3, and supplying a test signal having a positive polarity to even numbered Blue sub-pixels from the fifth test pad 42 of the second test part 4. The method includes supplying a test signal having a positive polarity to odd numbered Green sub-pixels from the third test pad 33 of the first test part 3, and supplying a test signal having a negative polarity to even numbered Green sub-pixels from the sixth test pad 43 of the second test part 4. The negative and positive polarities are illustrated in FIG. 5. FIG. 6 illustrates another arrangement of positive and negative polarities.

The method of testing the display panel according to an embodiment of the present invention may further include the process of repetitively performing the first testing step and the second testing step after changing a voltage level of the test signal. That is, after changing the voltage level of the first test signal and the second signal, the test apparatus 200 supplies the first test signal with the changed voltage level to the (2K−1)th data lines, and supplies the second test signal with the changed voltage level to the 2Kth data lines through the use of first test part 3 and second test part 4. Accordingly, the method of testing the display panel according to an embodiment of the present invention enables changing the voltage level of the test signal based on the corresponding grayscale for the lighting test, whereby the lighting test can be performed by each grayscale for the display panel 1.

The above process of repetitively performing the first testing step and the second testing step after changing the voltage level of the test signal can be performed by repetitively performing the first testing step and the second testing step until the lighting test for the first grayscale is completed, and then repetitively performing the first testing step and the second testing step when the voltage level of the test signal is changed based on the second grayscale, which is different from the first grayscale, after completing the lighting test for the first grayscale. The process of repetitively performing the first and second testing steps after applying the changed voltage level of the test signal can be repetitively performed until completing the lighting test for all desired grayscales of the display panel 1. In this instance, the number and order of grayscales to be performed by the lighting test for the display panel 1 may be preset by a user.

Referring to FIGS. 4 to 7, if performing the lighting test for the display panel 1 including the first data lines RD1 to RDm connected with the first sub-pixels SP1, the second data lines GD1 to GDm connected with the second sub-pixels SP2 and the third data lines BD1 to BDm connected with the third sub-pixels SP3, the method of testing the display panel 1 can include the following processes.

First, the first test signal is supplied to the (2K−1)th first data lines among the first data lines RD1 to RDm. This process can be performed by supplying the first test signal to the (2K−1)th first data lines through the first test part 3 and the second test part 4, wherein the first test signal alternately applies the positive polarity (+) test signal and the negative polarity (−) test signal, in sequence, with respect to the common voltage Vcom. The process of supplying the first test signal to the (2K−1)th first data lines can be performed by supplying the first test signal to the (2K−1)th first data lines through the first test pad 31 and the first connection line 35 under the condition that the test apparatus (see '200' of FIG. 7) is brought into contact with the first test pad 31.

Then, the second test signal is supplied to the 2Kth first data lines among the first data lines RD1 to RDm. This process can be performed by supplying the second test signal to the 2Kth first data lines through the first test part 3 and the second test part 4, where the second test signal alternately applies the negative polarity (−) test signal and the positive polarity (+) test signal, in sequence, with respect to the common voltage Vcom. The process of supplying the second test signal to the 2Kth first data lines can be performed by supplying the second test signal to the 2Kth first data lines through the fourth test pad 41 and the fourth connection line 45 under the condition that the test apparatus 200 is brought into contact with the fourth test pad 41.

Both the process of supplying the second test signal to the 2Kth first data lines and the process of supplying the first test signal to the (2K−1)th first data lines can be performed at the same time. Thus, the method of testing the display panel according to an embodiment of the present invention can simultaneously supply the test signals having the opposite polarities to the (2K−1)th first data lines and the 2Kth first data lines.

Accordingly, the method of testing the display panel according to an embodiment of the present invention can alternately light the first sub-pixels SP1 connected with the (2K−1)th first data lines, and the first sub-pixels SP1 connected with the 2Kth first data lines during the lighting test. Thus, the method of testing the display panel according to an embodiment of the present invention prevents occurrence of flicker during the lighting test, thereby facilitating the process of lighting test.

Also, the method of testing the display panel according to an embodiment of the present invention enables to decrease the frequency for the test signal, and thus to increase the time for applying the positive polarity (+) test signal and the negative polarity (−) test signal to the first sub-pixels SP1. Thus, the method of testing the display panel according to an embodiment of the present invention prevents occurrence of flicker during the lighting test, and simultaneously increases the time for charging the first sub-pixels SP1 with the pixel voltage, thereby obtaining easiness of process and accuracy on the lighting test.

Thereafter, the second test signal is supplied to the (2K−1)th second data lines among the second data lines GD1 to GDm. This process can be performed by supplying the second test signal to the (2K−1)th second data lines through the first test part 3 and the second test part 4. The process of supplying the second test signal to the (2K−1)th second data lines can be performed by supplying the second test signal to the (2K−1)th second data lines through the second test pad 32 and the second connection line 36 under the condition that the test apparatus 200 is brought into contact with the second test pad 32.

Then, the first test signal is supplied to the 2Kth second data lines among the second data lines GD1 to GDm. This process can be performed by supplying the first test signal to the 2Kth second data lines through the first test part 3 and the second test part 4. The process of supplying the first test signal to the 2Kth second data lines can be performed by supplying the first test signal to the 2Kth second data lines through the fifth test pad 42 and the fifth connection line 46 under the condition that the test apparatus 200 is brought into contact with the fifth test pad 42.

Both the process of supplying the first test signal to the 2Kth second data lines and the process of supplying the second test signal to the (2K−1)th second data lines can be performed at the same time. Thus, the method of testing the display panel according to an embodiment of the present invention can simultaneously supply the test signals having the opposite polarities to the (2K−1)th second data lines and the 2Kth second data lines.

Accordingly, the method of testing the display panel according to an embodiment of the present invention can alternately light the second sub-pixels SP2 connected with the (2K−1)th second data lines, and the second sub-pixels SP2 connected with the 2Kth second data lines during the lighting test. Thus, the method of testing the display panel according to an embodiment of the present invention prevents occurrence of flicker during the lighting test, thereby facilitating the process of lighting test.

Also, the method of testing the display panel according to an embodiment of the present invention enables to decrease the frequency for the test signal, and thus to increase the time for applying the positive polarity (+) test signal and the negative polarity (−) test signal to the second sub-pixels SP2. Thus, the method of testing the display panel according to an embodiment of the present invention prevents occurrence of flicker during the lighting test, and simultaneously increases the time for charging the second sub-pixels SP2 with the pixel voltage, thereby obtaining easiness of process and accuracy on the lighting test.

Thereafter, the first test signal is supplied to the (2K−1)th third data lines among the third data lines BD1 to BDm. This process can be performed by supplying the first test signal to the (2K−1)th third data lines through the first test part 3 and the second test part 4. The process of supplying the first test signal to the (2K−1)th third data lines can be performed by supplying the first test signal to the (2K−1)th third data lines through the third test pad 33 and the third connection line 37 under the condition that the test apparatus 200 is brought into contact with the third test pad 33.

Then, the second test signal is supplied to the 2Kth third data lines among the third data lines BD1 to BDm. This process can be performed by supplying the second test signal to the 2Kth third data lines through the first test part 3 and the second test part 4. The process of supplying the second test signal to the 2Kth third data lines can be performed by supplying the second test signal to the 2Kth third data lines through the sixth test pad 43 and the sixth connection line 47 under the condition that the test apparatus 200 is brought into contact with the sixth test pad 43.

Both the process of supplying the second test signal to the 2Kth third data lines and the process of supplying the first test signal to the (2K−1)th third data lines can be performed at the same time. Thus, the method of testing the display panel according to an embodiment of the present invention can simultaneously supply the test signals having the opposite polarities to the (2K−1)th third data lines and the 2Kth third data lines.

Accordingly, the method of testing the display panel according to an embodiment of the present invention can alternately light on the third sub-pixels SP3 connected with the (2K−1)th third data lines, and the third sub-pixels SP3 connected with the 2Kth third data lines during the lighting test. Thus, the method of testing the display panel according to an embodiment of the present invention prevents occurrence of flicker during the lighting test, thereby facilitating the process of lighting test.

Also, the method of testing the display panel according to an embodiment of the present invention enables to decrease the frequency for the test signal, and thus to increase the time for applying the positive polarity (+) test signal and the negative polarity (−) test signal to the third sub-pixels SP3. Thus, the method of testing the display panel according to an embodiment of the present invention prevents occurrence of flicker during the lighting test, and simultaneously increases the time for charging the third sub-pixels SP3 with the pixel voltage, thereby obtaining easiness of process and accuracy on the lighting test.

The process of supplying the first test signal to the (2K−1)th first data lines, the process of supplying the second test signal to the (2K−1)th second data lines, the process of supplying the first test signal to the (2K−1)th third data lines, the process of supplying the second test signal to the 2Kth first data lines, the process of supplying the first test signal to the 2Kth second data lines, and the process of supplying the second test signal to the 2Kth third data lines can be performed at the same time.

Thus, when the method of testing the display panel according to an embodiment of the present invention, the test signal is sequentially supplied in order of positive polarity, negative polarity, positive polarity, negative polarity, positive polarity and negative polarity, as shown in FIG. 5, along the arrangement direction of the data lines RD1 to RDm, GD1 to GDm and BD1 to BDm; and then the test signal is sequentially supplied in order of negative polarity, positive polarity, negative polarity, positive polarity, negative polarity and positive polarity, as shown in FIG. 6, thereby performing the lighting test in the column inversion method. As a result, the method of testing the display panel according to an embodiment of the present invention can be performed under the same condition as the virtual driving environment of the display device, thereby realizing more-improved accuracy and reliability on the lighting test.

According to an embodiment of the present invention, it is possible to prevent the occurrence of flicker during a lighting test, and to increase time for charging the pixels with a pixel voltage, hereby obtaining easiness of process and accuracy on the lighting test.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A display panel, comprising:

a display part including a plurality of sub-pixels configured to display a plurality of colors, and a plurality of data lines connected with the sub-pixels;

a first test part configured to supply a test signal to corresponding odd or even data lines for (2K−1)th data lines ('K' is an integer above 0) by each color of the sub-pixels among the plurality of data lines; and a second test part configured to supply a test signal to other data lines other than the corresponding odd or even data lines for 2Kth data lines by each color for the sub-pixels among the plurality of data lines when the first test part supplies the test signal, wherein a polarity of the test signal supplied by the second test part is opposite to a polarity of the test signal supplied by the first test part, wherein the first test part includes a first plurality of test pads configured to be in contact with a test apparatus and receive test signals from the test apparatus, wherein the second test part includes a second plurality of test pads configured to be in contact with the test apparatus and receive test signals from the test apparatus, wherein the first test part is configured to supply a positive polarity test signal to a first group of corresponding data lines among the corresponding odd or even data lines connected with first corresponding sub-pixels, supply a negative polarity test signal to a second group of corresponding data lines among the corresponding odd or even data lines connected with second corresponding sub-pixels positioned next to the first corresponding sub-pixels, and supply the positive polarity test signal to a third group of corresponding data lines among the corresponding odd or even data lines connected with third corresponding sub-pixels positioned next to the second corresponding sub-pixels, and wherein the second test part is further configured to supply the negative polarity test signal to a first group of other data lines among the other data lines, supply the positive polarity test signal to a second group of other data lines among the other data lines, and supply the negative polarity test signal to a third group of other data lines among the other data lines.

2. The display panel of claim 1, wherein the first test part and the second test part alternately light the sub-pixels connected with the corresponding odd or even data lines and the sub-pixels connected with the other data lines for each color for the sub-pixels.

3. The display panel of claim 1, wherein the first test part is further configured to alternately supply positive polarity and negative polarity test signals, in sequence, by firstly supplying the positive polarity test signal and secondly supplying the negative polarity test signal to the first group of corresponding data lines among the corresponding odd or even data lines connected with the first corresponding sub-pixels, and wherein the second test part is further configured to alternately supply negative polarity and positive polarity test signals, in sequence, by firstly supplying the negative polarity test signal and secondly supplying the positive polarity test signal to the first group of other data lines among the other data lines, so as to alternately light on the first corresponding sub-pixels connected with the first group of corresponding data lines and first other sub-pixels connected with the first group of other data lines.

4. The display panel of claim 1, wherein the first test part and the second test part are further configured to simultaneously supply the test signals having opposite polarities to the corresponding odd or even data lines and the other data lines for each color for the sub-pixels so as to perform a lighting test in a column inversion method.

5. The display panel of claim 1, wherein the first test part and the first plurality of test pads include:

a first test pad configured to be in contact with the test apparatus so as to receive a first test signal from the test apparatus, wherein a positive polarity test signal and negative polarity test signal with respect to a common voltage are sequentially supplied and alternately applied as the first test signal;

a second test pad configured to be in contact with the test apparatus so as to receive a second test signal from the test apparatus, wherein a negative polarity test signal and positive polarity test signal with respect to a common voltage are sequentially supplied and alternately applied as the second test signal;

a third test pad configured to be in contact with the test apparatus so as to receive the first test signal from the test apparatus;

a first connection line connecting the first test pad with the first group of corresponding data lines among the corresponding odd or even data lines connected with first corresponding sub-pixels to display a first color;

a second connection line connecting the second test pad with the second group of corresponding data lines among the corresponding odd or even data lines connected with second corresponding sub-pixels to display a second color; and a third connection line connecting the third test pad with the third group of corresponding data lines among the corresponding odd or even data lines connected with third corresponding sub-pixels to display a third color.

6. The display panel of claim 5, wherein the second test part and the second plurality of test pads include:

a fourth test pad configured to be in contact with the test apparatus so as to receive the second test signal from the test apparatus;

a fifth test pad configured to be in contact with the test apparatus so as to receive the first test signal from the test apparatus;

a sixth test pad configured to be in contact with the test apparatus so as to receive the second test signal from the test apparatus;

a fourth connection line connecting the fourth test pad with the first group of other data lines among the other data lines;

a fifth connection line connecting the fifth test pad with the second group of other data lines among the other data lines; and a sixth connection line connecting the sixth test pad with the third group of other data lines among the other data lines.

7. The display panel of claim 1, wherein the first test part includes a first connection line connecting the first test pad with the first group of corresponding data lines among the corresponding odd or even data lines connected with first corresponding sub-pixels to display a first color, and a second connection line connecting the second test pad with the second group of corresponding data lines among the corresponding odd or even data lines connected with second corresponding sub-pixels to display a second color; and wherein the second test part includes a fourth connection line connecting the fourth test pad with the first group of other data lines among the other data lines, and a fifth connection line connecting the fifth test pad with the second group of other data lines among the other data lines.

8. The display panel of claim 7, wherein the first test part includes a third connection line connecting the third test pad with the third group of corresponding data lines among the corresponding odd or even data lines connected with third corresponding sub-pixels to display a third color; and wherein the second test part includes a sixth connection line connecting the sixth test pad with the third group of other data lines among the other data lines.

9. The display panel of claim 1, wherein the first test part includes a first connection line connecting the first test pad with the first group of corresponding data lines among the corresponding odd or even data lines connected with first corresponding sub-pixels to display a red color, and a second connection line connecting the second test pad with the second group of corresponding data lines among the corresponding odd or even data lines connected with second corresponding sub-pixels to display a green color; and wherein the second test part includes a fourth connection line connecting the fourth test pad with the first group of other data lines among the other data lines, and a fifth connection line connecting the fifth test pad the second group of other data lines among the other data lines.

10. The display panel of claim 1, wherein the first test part includes a first connection line connecting the first test pad with the first group of corresponding data lines among the corresponding odd or even data lines connected with first corresponding sub-pixels to display a cyan color, and a second connection line connecting the second test pad with the second group of corresponding data lines among the corresponding odd or even data lines connected with second corresponding sub-pixels to display a magenta color; and wherein the second test part includes a fourth connection line connecting the fourth test pad with the first group of other data lines among the other data lines, and a fifth connection line connecting the fifth test pad with the second group of other data lines among the other data lines.

11. The display panel of claim 5, wherein the first test part includes:

a first enable pad configured to be in contact with the test apparatus; and a first enable connection line connecting the first enable pad with the respective switching elements included in the first connection line, the second connection line and the third connection line.

12. The display panel of claim 6, wherein the second test part includes:

a second enable pad configured to be in contact with the test apparatus; and a second enable connection line connecting the second enable pad with the respective switching elements included in the fourth connection line, the fifth connection line and the sixth connection line.

13. The display panel of claim 1, wherein the first test part and the second test part are positioned in a non-display part corresponding to a circumferential area of the display part.

* * * * *